US011830402B1

(12) United States Patent
Shen et al.

(10) Patent No.: US 11,830,402 B1
(45) Date of Patent: Nov. 28, 2023

(54) DISPLAY CIRCUIT OF SPECIAL-SHAPED SCREEN AND DISPLAY DEVICE

(71) Applicant: HKC CORPORATION LIMITED, Shenzhen (CN)

(72) Inventors: Tingting Shen, Shenzhen (CN); Rongrong Li, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/207,687

(22) Filed: Jun. 9, 2023

(30) Foreign Application Priority Data

Sep. 8, 2022 (CN) ..... 202211095231.6

(51) Int. Cl.
*G09G 3/20* (2006.01)
*G09G 3/34* (2006.01)

(52) U.S. Cl.
CPC ..... *G09G 3/20* (2013.01); *G09G 3/3406* (2013.01); *G09G 2300/0439* (2013.01);
(Continued)

(58) Field of Classification Search
CPC ..... G09G 3/20; G09G 3/3406; G09G 2300/0439; G09G 2300/0819;
(Continued)

(56) References Cited

U.S. PATENT DOCUMENTS 9,311,855 B2 * 4/2016 Jung ..... G06F 3/0412
9,449,993 B2 * 9/2016 Kim ..... H01L 27/124
(Continued)

FOREIGN PATENT DOCUMENTS

CN 101364395 A 2/2009
CN 103399442 A 11/2013
(Continued)

OTHER PUBLICATIONS

«Liquid Crystal and Display» Issue 05, May 15, 2019 ; Zhao Chongyang et al. ; The Influence of Pixel Electrode Coupling Capacitance on Display Image Quality in TFT-LCD (4 pages).
(Continued)

*Primary Examiner* — Michael Pervan

(57) ABSTRACT

A display circuit of a special-shaped screen and a display device. The display circuit includes multiple pixel circuits arranged in a special-shaped region of the special-shaped screen in a manner of a non-rectangular array; pixel circuits located at both ends of each row of the plurality of pixel circuits being edge pixel circuits, one of two adjacent edge pixel circuits being connected to a $N^{th}$ level gate signal line, the other one of the two adjacent edge pixel circuits being connected to a $(N+1)^{th}$ level gate signal line, and N is a natural number greater than 0; a voltage-dividing circuit connected to each of the two adjacent edge pixel circuits, to enable the two adjacent edge pixel circuits to have equal storage voltages, a control end of the voltage-dividing circuit being connected to a $(N+M)^{th}$ level gate signal line, and M being a natural number greater than 2.

20 Claims, 2 Drawing Sheets

(52) U.S. Cl.
CPC ..... *G09G 2300/0819* (2013.01); *G09G 2300/0842* (2013.01); *G09G 2310/0202* (2013.01); *G09G 2310/0262* (2013.01); *G09G 2320/0233* (2013.01)

(58) Field of Classification Search
CPC ... G09G 2300/0842; G09G 2310/0202; G09G 2310/0262; G09G 2320/0233
See application file for complete search history.

(56) References Cited

U.S. PATENT DOCUMENTS

| | | | | |
|---|---|---|---|---|
| 9,940,866 | B2 * | 4/2018 | Lin | G09G 3/2092 |
| 9,965,995 | B2 * | 5/2018 | Chen | G09G 3/20 |
| 9,978,306 | B2 * | 5/2018 | Lee | G09G 3/3225 |
| 10,108,149 | B2 * | 10/2018 | Kang | G04G 9/0082 |
| 10,134,328 | B2 * | 11/2018 | Nam | G09G 3/3688 |
| 10,159,147 | B2 * | 12/2018 | Kim | G04G 17/02 |
| 10,372,085 | B2 * | 8/2019 | Kang | G04G 9/04 |
| 10,877,440 | B2 * | 12/2020 | Kang | G04G 9/04 |
| 11,328,676 | B2 * | 5/2022 | Hyeon | H10K 77/111 |
| 11,335,713 | B2 * | 5/2022 | Cho | H01L 27/1244 |
| 11,360,438 | B2 * | 6/2022 | Kang | G04G 9/04 |
| 11,670,244 | B2 * | 6/2023 | Hyeon | H10K 77/111 345/76 |
| 2008/0180372 | A1 | 7/2008 | Kim et al. | |
| 2009/0262054 | A1 | 10/2009 | Hsu et al. | |
| 2012/0162556 | A1 | 6/2012 | Chen et al. | |
| 2013/0321734 | A1 | 12/2013 | Won et al. | |
| 2016/0035284 | A1 * | 2/2016 | Jung | G06F 1/163 345/82 |
| 2016/0113106 | A1 * | 4/2016 | Kim | H05K 1/028 361/679.01 |
| 2016/0190166 | A1 * | 6/2016 | Kim | H01L 27/124 257/71 |
| 2016/0275910 | A1 * | 9/2016 | Lee | G09G 3/3225 |
| 2016/0351098 | A1 * | 12/2016 | Lin | G02F 1/1345 |
| 2016/0351107 | A1 * | 12/2016 | Chen | G02F 1/1345 |
| 2016/0363909 | A1 * | 12/2016 | Kang | G04C 17/0091 |
| 2017/0084225 | A1 * | 3/2017 | Nam | G09G 3/3275 |
| 2019/0056699 | A1 * | 2/2019 | Kang | G04C 17/0091 |
| 2019/0140036 | A1 * | 5/2019 | Hyeon | H10K 77/111 |
| 2019/0361405 | A1 * | 11/2019 | Kang | G04C 17/0091 |
| 2020/0303421 | A1 * | 9/2020 | Cho | G09G 3/3233 |
| 2021/0088978 | A1 * | 3/2021 | Kang | G04C 17/0091 |
| 2022/0238562 | A1 * | 7/2022 | Cho | H10K 59/1213 |
| 2022/0262319 | A1 * | 8/2022 | Hyeon | H10K 59/131 |
| 2022/0317631 | A1 * | 10/2022 | Kang | G04G 9/0082 |

FOREIGN PATENT DOCUMENTS

| | | | |
|---|---|---|---|
| CN | 103474028 | A | 12/2013 |
| CN | 104062790 | A | 9/2014 |
| CN | 105514134 | A | 4/2016 |
| CN | 107784971 | A | 3/2018 |
| CN | 107958919 | A | 4/2018 |
| CN | 108922469 | A | 11/2018 |
| CN | 110189700 | A | 8/2019 |
| CN | 111369933 | A | 7/2020 |
| CN | 112234073 | A | 1/2021 |
| CN | 113823214 | A | 12/2021 |
| CN | 115083362 | A | 9/2022 |
| JP | 2010079158 | A | 4/2010 |
| KR | 20190061357 | A | 6/2019 |
| KR | 20210156923 | A | 12/2021 |

OTHER PUBLICATIONS

Chinese First Office Action,Chinese Application No. 202211095231.6, dated Oct. 24, 2022 (17 pages).
Notification to Grant Patent Right for Invention, Chinese Application No. 202211095231.6, dated Jan. 7, 2022 (6 pages).

* cited by examiner

DISPLAY CIRCUIT OF SPECIAL-SHAPED SCREEN AND DISPLAY DEVICE

CROSS REFERENCE TO RELATED ART

The present disclosure claims priority to Chinese Patent Application No. 202211095231.6, filed on Sep. 8, 2022 in the National Intellectual Property Administration of China, the contents of which are herein incorporated by reference in its entirety.

TECHNICAL FIELD

The present disclosure relates to the field of display technologies, and in particular to a display circuit of a special-shaped screen and a display device.

BACKGROUND

With the development of the era, people have higher and higher requirements for display screens. In some specific application scenarios, it is necessary to adopt special-shaped screens having functions of displaying special-shaped images to serve as the display screens to meet particular requirements of users.

The drawback of the related art lies in the following. Since the special-shaped screens usually have arc-shaped or other unconventional-shaped edges, and display regions of the special-shaped screens are usually composed of pixel circuits in arrays, jagged effects of displayed images corresponding to edges of the special-shaped screens may be more serious than that of rectangular screens, which may further cause worse display effects of the special-shaped screens.

SUMMARY OF THE DISCLOSURE

A first technical scheme adopted by the present disclosure is: a display circuit of a special-shaped screen, including: a plurality of pixel circuits, arranged in a special-shaped region of the special-shaped screen in a manner of a non-rectangular array; wherein pixel circuits located at both ends of each row of the plurality of pixel circuits are edge pixel circuits, one of two adjacent edge pixel circuits is connected to a $N^{th}$ level gate signal line, the other one of the two adjacent edge pixel circuits is connected to a $(N+1)^{th}$ level gate signal line, and N is a natural number greater than 0; a voltage-dividing circuit, connected to each of the two adjacent edge pixel circuits, respectively, to enable the two adjacent edge pixel circuits to have equal storage voltages, a control end of the voltage-dividing circuit being connected to a $(N+M)^{th}$ level gate signal line, and M being a natural number greater than 2; wherein a signal transmitted by the $N^{th}$ level gate signal line, a signal transmitted by the $(N+1)^{th}$ level gate signal line, and a signal transmitted by the $(N+M)^{th}$ level gate signal line are output in sequence according to an order from front to back.

In some embodiments, the display circuit includes a plurality of pixel circuits arranged in a rectangular region of the special-shaped screen in a manner of a rectangular array; and the plurality of pixel circuits, arranged in the special-shaped screen in the manner of the non-rectangular array.

In some embodiments, an edge pixel circuit located at one end of a $N^{th}$ row of the plurality of pixel circuits includes a first edge pixel circuit, connected to the $N^{th}$ level gate signal line; and a second edge pixel circuit, adjacent to the first edge pixel circuit, and connected to the $(N+1)^{th}$ level gate signal line.

In some embodiments, a pixel circuit other than the edge pixel circuits in the plurality of pixel circuits is a non-edge pixel circuit, and a non-edge pixel circuit located on the same row with and adjacent to the first edge pixel circuit or the second edge pixel circuit is an adjacent-edge pixel circuit; wherein the first edge pixel circuit, the second edge pixel circuit, and the adjacent-edge pixel circuit are connected to a same-level data signal line.

In some embodiments, an edge pixel circuit located at one end of a $N^{th}$ row of the plurality of pixel circuits is a first edge pixel circuit, and an edge pixel circuit located at one end of a $(N+1)^{th}$ row of the plurality of pixel circuits and adjacent to the first edge pixel circuit is a second edge pixel circuit; wherein the first edge pixel circuit is connected to the $N^{th}$ level gate signal line, and the second edge pixel circuit is connected to the $(N+1)^{th}$ level gate signal line.

In some embodiments, a pixel circuit other than the edge pixel circuits in the plurality of pixel circuits is a non-edge pixel circuit, a non-edge pixel circuit located on the same row with and adjacent to the first edge pixel circuit is a first adjacent-edge pixel circuit, and a non-edge pixel circuit located on the same row with and adjacent to the second edge pixel circuit is a second adjacent-edge pixel circuit; wherein the first edge pixel circuit, the second edge pixel circuit, the first adjacent-edge pixel circuit, and the second adjacent-edge pixel circuit are connected to a same-level data signal line.

In some embodiments, M is equal to 2.

In some embodiments, each pixel circuit includes: a first switch transistor; and a storage capacitor; wherein a driving end of the first switch transistor is connected to a corresponding gate signal line, a first end of the first switch transistor is connected to a corresponding data signal line, a second end of the first switch transistor is connected to a first end of the storage capacitor, and a second end of the storage capacitor is connected to a corresponding common electrode.

In some embodiments, the voltage-dividing circuit includes: a second switch transistor; wherein a first end of the second switch transistor is connected to the first end of the storage capacitor of one of the two adjacent edge pixel circuits, a second end of the second switch transistor is connected to the first end of the storage capacitor of the other one of the two adjacent edge pixel circuits, and a driving end of the second switch transistor is connected to the $(N+M)^{th}$ level gate signal line.

A second technical scheme adopted by the present disclosure is: a display device, includes a backlight module; and the above display circuit.

BRIEF DESCRIPTION OF THE DRAWINGS

In order to more clearly illustrate the technical solutions in the embodiments of the present disclosure, the following is a brief description of the drawings required for the description of the embodiments. Obviously, the drawings in the following description are only some embodiments of the present disclosure. Those skilled in the art may acquire other drawings based on these drawings without creative work.

DETAILED DESCRIPTION

The present disclosure will be further described in detail in conjunction with the accompanying drawings and embodiments in the following. It is particular noted that the following embodiments are only provided to illustrate the present disclosure, and not intended to limit the scope of the present disclosure. Similarly, the following embodiments are only a part but not all of the embodiments of the present disclosure. Other embodiments acquired by a person of ordinary skill in the art without creative work fall within the scope of the present disclosure.

"Embodiment" herein means that a particular feature, structure, or characteristic described with reference to embodiments may be included in at least one embodiment of the present disclosure. The term appearing in various places in the specification are not necessarily as shown in the same embodiment, and are not independent or alternative embodiments that are mutually exclusive with other embodiments. Those skilled in the art will understand explicitly and implicitly that the embodiments described herein may be combined with other embodiments.

In the description of the present disclosure, it should be noted that, unless specified or limited, otherwise, terms "mounted", "configured", "coupled", "connected", and the like may be used in a broad sense, and may include, for example, fixed connections, detachable connections, or integral connections; may also be mechanical, or electrical connections; may also be direct connections or indirect connections via intervening media. One of ordinary skill in the art may understand specific meanings of the above terms according to specific cases.

Figure 4:
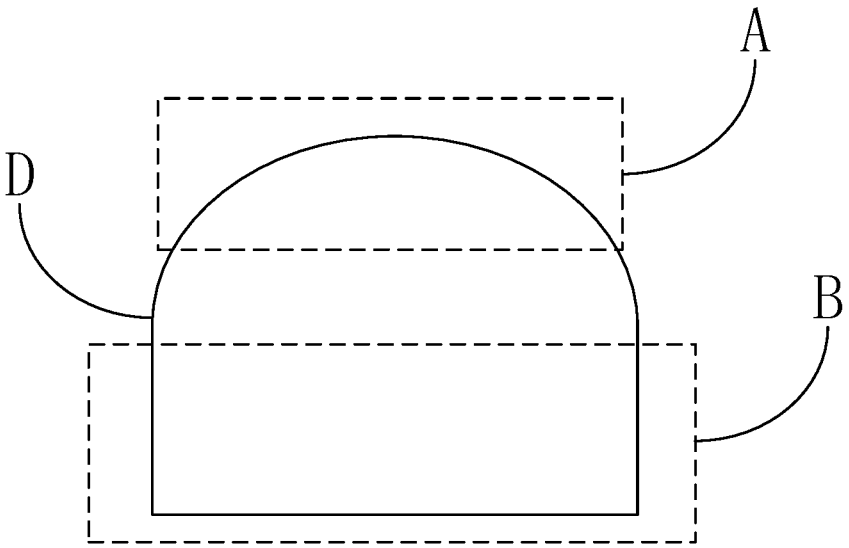
FIG. 4 is a schematic view of a display region of the special-shaped screen according to an embodiment of the present disclosure.

It should be firstly noted that an entire display region D of a special-shaped screen may include a special-shaped region and a rectangular region. FIG. 4 is a schematic view of a display region of the special-shaped screen according to an embodiment of the present disclosure. As shown in FIG. 4, the entire display region D of the special-shaped screen may include the special-shaped region A shown in FIG. 4, and pixel circuits arranged in an array in the special-shaped region A constitute a non-rectangular display region. The entire display region D of the special-shaped screen may further include the rectangular region B shown in FIG. 4, and pixel circuits arranged in an array in the rectangular region B constitute a rectangular display region.

Figure 1:
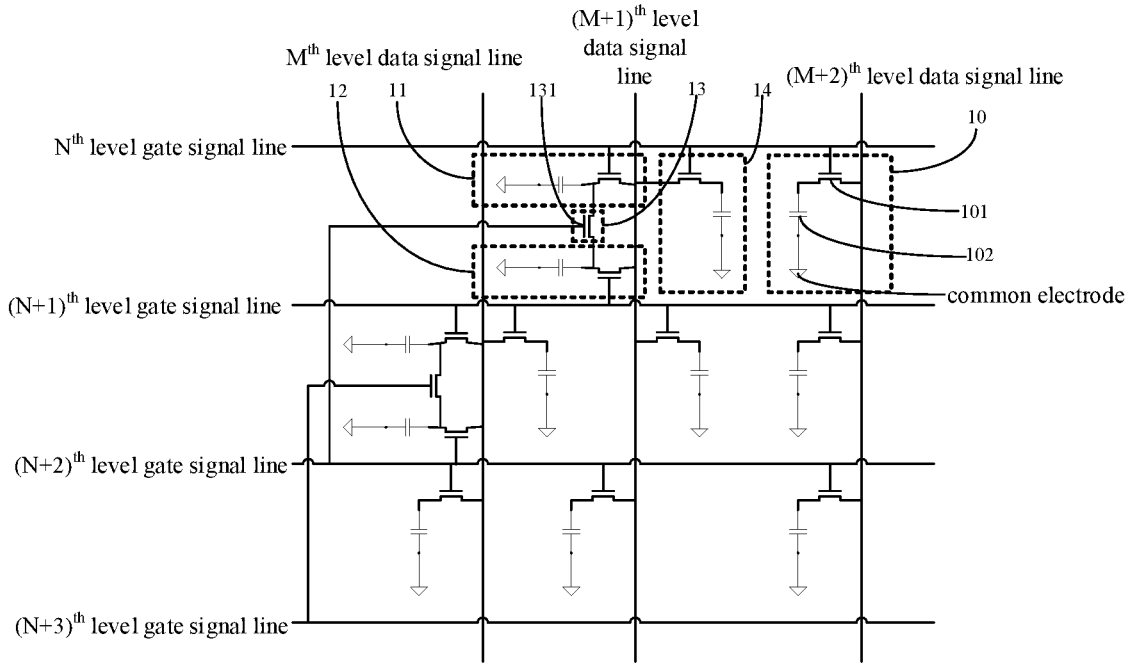
FIG. 1 is a structural schematic view of a display circuit of a special-shaped screen according to an embodiment of the present disclosure.

A display circuit of the special-shaped screen is first disclosed in the present disclosure. FIG. 1 is a structural schematic view of the display circuit of the special-shaped screen according to an embodiment of the present disclosure. As shown in FIG. 1, the display circuit includes a plurality of pixel circuits 10 arranged in the special-shaped region of the special-shaped screen in a manner of a non-rectangular array. Structures such as a liquid crystal layer, an electrode layer, etc., corresponding to the pixel circuits 10 are not shown in FIG. 1.

Pixel circuits located at both ends of each row of the plurality of pixel circuits 10 may be denoted as edge pixel circuits. That is, all edge pixel circuits are pixel circuits located at an edge of the special-shaped screen.

One of two adjacent edge pixel circuits in the plurality of pixel circuits 10 on all rows is connected to a $N^{th}$ level gate signal line, the other one of the two adjacent edge pixel circuits is connected to a $(N+1)^{th}$ level gate signal line, and N is a natural number greater than 0. In this way, the two adjacent edge pixel circuits may display based on gate signals transmitted on corresponding gate signal lines, respectively.

In an embodiment, each pixel circuit 10 may include a first switch transistor 101 and a storage capacitor 102.

A driving end of the first switch transistor 101 is connected to a corresponding gate signal line, a first end of the first switch transistor 101 is connected to a corresponding data signal line, a second end of the first switch transistor 101 is connected to a first end of the storage capacitor, and a second end of the storage capacitor 102 is connected to a corresponding common electrode.

The driving end of the first switch transistor 101 is configured to receive a corresponding gate signal (such as a signal transmitted by the $N^{th}$ level gate signal line in FIG. 1), the first end of the first switch transistor 101 is configured to receive a corresponding data signal (such as a signal transmitted by a $(M+2)^{th}$ level data signal line in FIG. 1), and the second end of the first switch transistor 101 is connected to the first end of the storage capacitor 102. The second end of the storage capacitor 102 is configured to receive a corresponding voltage signal of the common electrode (such as a signal transmitted by the common electrode in FIG. 1). The storage capacitor 102 may store electrical energy based on a voltage difference between a received data signal and the voltage signal of the common electrode, to enable the liquid crystal layer of each pixel circuit 10 to operate based on stored electrical energy, such that the pixel circuits 10 may perform a corresponding displaying operation. The data signal may also be referred to as a pixel voltage signal.

It should be noted herein, one of the two adjacent edge pixel circuits described above may be denoted as a first edge pixel circuit 11, and the other one of the two adjacent edge pixel circuits may be denoted as a second edge pixel circuit 12. Both the first edge pixel circuit 11 and the second edge pixel circuit 12 are pixel circuits 10. That is, as shown in FIG. 1, in the first edge pixel circuit 11 or the second edge pixel circuit 12, the switch transistor shown is the first switch transistor 101 in the first edge pixel circuit 11 or the second edge pixel circuit 12, and the capacitor shown is the storage capacitor 102 in the first edge pixel circuit 11 or the second edge pixel circuit 12.

The display circuit further includes a voltage-dividing circuit 13. The voltage-dividing circuit 13 is connected to each of the two adjacent edge pixel circuits described above, respectively. A control end of the voltage-dividing circuit is connected to a $(N+M)^{th}$ level gate signal line, and M is a natural number greater than 2. The voltage-dividing circuit may be configured to neutralize voltages on storage capacitors 102 of the two adjacent edge pixel circuits in response to receiving a gate signal in the $(N+M)^{th}$ level gate signal line, to enable the two adjacent edge pixel circuits have equal storage voltages. In this way, the two adjacent edge pixel circuits may both display with luminance corresponding to a neutralized voltage.

In an embodiment, in the display circuit, gate signals in all gate signal lines are usually output according to level numbers, one by one from small to large, such that each row of the pixel circuits in a display screen (such as the special-shaped screen) may receive a corresponding gate signal in turn. In this way, the plurality of the pixel circuits may display row by row until a display of the image in the screen may be completed for one time. That is, the signal transmitted by the $N^{th}$ level gate signal line, a signal transmitted by the $(N+1)^{th}$ level gate signal line, and a signal transmitted by the $(N+M)^{th}$ level gate signal line are output in sequence according to an order from front to back.

The voltage-dividing circuit 13 includes a second switch transistor 131. A first end of the second switch transistor 131 is connected to the first end of the storage capacitor 102 of one of the two adjacent edge pixel circuits, a second end of the second switch transistor 131 is connected to the first end of the storage capacitor 102 of the other one of the two adjacent edge pixel circuits, and a driving end of the second switch transistor 131 is connected to the $(N+M)^{th}$ level gate signal line.

Based on an above-mentioned output manner of the gate signals, the first edge pixel circuit 11 may be allowed to firstly receive the signal transmitted by the $N^{th}$ level gate signal line and charge the storage capacitor 102 in the first edge pixel circuit 11 based on a corresponding data signal. The second edge pixel circuit 12 is allowed to secondly receive the signal transmitted by the $(N+1)^{th}$ level gate signal line and charge the storage capacitor 102 in the second edge pixel circuit 12 based on a corresponding data signal. Subsequently, the second switch transistor 131 is conducted after receiving the signal transmitted by the $(N+M)^{th}$ level gate signal line, to enable the storage capacitor 102 in the first edge pixel circuit 11 and the storage capacitor 102 in the second edge pixel circuit 12 to be connected in parallel. In this way, one of the two storage capacitors 102 which has a higher voltage may charge or discharge the other one of the two storage capacitors 102 which has a lower voltage, such that the voltages on the two storage capacitors 102 may be neutralized after the two storage capacitors 102 are connected in parallel.

When a display luminance to be displayed by the first edge pixel circuit 11 based on an initial voltage of the storage capacitor 102 thereof after being charged is a first luminance, and a display luminance to be displayed by the second edge pixel circuit 12 based on an initial voltage of the storage capacitor 102 thereof after being charged is a second luminance, both the first edge pixel circuit 11 and the second edge pixel circuit 12 may display with a third luminance based on the display circuit and the output manner of the gate signals described above. The third luminance is between the first luminance and the second luminance.

In an embodiment, as shown in FIG. 1, M may be 2. That is, the signal transmitted by the $(N+M)^{th}$ level gate signal line is a signal transmitted by a $(N+2)^{th}$ level gate signal line. In terms of an output subsequence, the signal transmitted by the $(N+2)^{th}$ level gate signal line is after the signal transmitted by the $(N+1)^{th}$ level gate signal line, and the signal transmitted by the $(N+1)^{th}$ level gate signal line is after the signal transmitted by the $N^{th}$ level gate signal line.

In the above way, the two storage capacitors 102 may be connected in panel as soon as possible after both the storage capacitor 102 in the first edge pixel circuit 11 and the storage capacitor 102 in the second edge pixel circuit 12 complete charging operations, to further complete a voltage neutralization between capacitors, so as to avoid both the first edge pixel circuit 11 and the second edge pixel circuit 12 to have displayed for an excessively long time based on initial voltages of corresponding storage capacitors 102 due to excessive time. In this way, a duration of the special-shaped screen appearing the jagged effect may be further reduced, and the display effect of the special-shaped screen may be improved.

In an embodiment, both the first switch transistor 101 and the second switch transistor 131 are thin film field effect transistors.

Each thin film field effect transistor may specifically include a substrate layer, a first metal layer, a first insulating layer, a semiconductor layer, a second metal layer, a second insulating layer, and an electrode layer.

Different from the related art, in the technical solution of the present disclosure, the pixel circuits located at both ends of each row of the plurality of pixel circuits are taken as the edge pixel circuits, one of two adjacent edge pixel circuits is connected to the $N^{th}$ level gate signal line to receive a gate signal in the $N^{th}$ level, the other one of the two adjacent edge pixel circuits is connected to the $(N+1)^{th}$ level gate signal line to receive the gate signal in the $(N+1)^{th}$ level. By the control end of the voltage-dividing circuit being connected to the $(N+M)^{th}$ level gate signal line, the voltages on the storage capacitors of the two adjacent edge pixel circuits are neutralized in response to receiving the gate signal in the $(N+M)^{th}$ level, and the two adjacent edge pixel circuits may have the equal storage voltages. In this way, the two adjacent edge pixel circuits may both display with the luminance corresponding to the storage voltages after the voltages are neutralized, such that the jagged effect occurred when the pixel circuits at the edge of the special-shaped screen display may be weakened and the display effect of the special-shaped screen may be improved.

In an embodiment, the display circuit may include not only the plurality of pixel circuits 10 arranged in the special-shaped region of the special-shaped screen in the manner of the non-rectangular array, but also a plurality of pixel circuits 10 arranged in the rectangular region of the special-shaped screen in a manner of a rectangular array.

In an embodiment, as shown in FIG. 4, the display circuit may include not only the plurality of pixel circuits 10 located in the special-shaped region A, but also the plurality of pixel circuits 10 located in the rectangular region B. That is, one of the two adjacent edge pixel circuits either in the special-shaped region A or in the rectangular region B may be connected to the $N^{th}$ level gate signal line, and the other one may be connected to the $(N+1)^{th}$ level gate signal line, so as to improve the display effect of the special-shaped screen.

In an embodiment, as shown in FIG. 1, in the plurality of pixel circuits 10, the edge pixel circuit located at one end of a $N^{th}$ row of the plurality of pixel circuits 10 includes the first edge pixel circuit 11 and the second edge pixel circuit 12, and the first edge pixel circuit 11 is adjacent to the second edge pixel circuit 12.

The first edge pixel circuit 11 is connected to the $N^{th}$ level gate signal line, and the second edge pixel circuit 12 is connected to the $(N+1)^{th}$ level gate signal line.

In an embodiment, in the special-shaped screen, the edge pixel circuit located at one end (e.g., a left end) of each row of pixel circuits may include a first edge pixel circuit 11 and a second edge pixel circuit 12. The first edge pixel circuit 11 and the second edge pixel circuit 12 may have an up-and-down arrangement relationship. The first edge pixel circuit 11 is adjacent to a previous row of the pixel circuits 10 and the second edge pixel circuit 12 is adjacent to a next row of the pixel circuits 10.

In the above way, each group of the first edge pixel circuits 11 and second edge pixel circuits 12 in all of the pixel circuits 10 may display with a corresponding third luminance as described above, which weakens the jagged effect at the edge of the special-shaped screen and improves the display effect of the special-shaped screen.

In an embodiment, a pixel circuit 10 other than the edge pixel circuits in the plurality of pixel circuits 10 is taken as a non-edge pixel circuit, and a non-edge pixel circuit located on the same row with and adjacent to the first edge pixel circuit 11 or the second edge pixel circuit 12 is taken as an adjacent-edge pixel circuit 14.

The first edge pixel circuit 11, the second edge pixel circuit 12, and the adjacent-edge pixel circuit are connected to a same-level data signal line.

The adjacent-edge pixel circuit 14 is located at a non-edge position of the special-shaped screen.

In an embodiment, the first end of the first switch transistor 101 of the first edge pixel circuit 11, the first end of the first switch transistor 101 of second edge pixel circuit 12, and the first end of the first switch transistor 101 of the adjacent-edge pixel circuit 14 are connected to a same data line to receive a corresponding data signal (such as a signal transmitted by a $(M+1)^{th}$ level data signal line shown in FIG. 1).

In the above way, the first edge pixel circuit 11/the second edge pixel circuit 12 and the adjacent-edge pixel circuit 14 are allowed to display with different but approached luminance, respectively, which further weakens the jagged effect of the special-shaped screen and improves the display effect of the special-shaped screen.

In an embodiment, as shown in FIG. 1, in the plurality of the pixel circuits 10, an edge pixel circuit located at one end of the $N^{th}$ row of the plurality of pixel circuits 10 is taken as the first edge pixel circuit 11, and an edge pixel circuit located at one end of a $(N+1)^{th}$ row of the plurality of pixel circuits and adjacent to the first edge pixel circuit 11 is taken as the second edge pixel circuit 12.

The first edge pixel circuit 11 is connected to the $N^{th}$ level gate signal line, and the second edge pixel circuit 12 is connected to the $(N+1)^{th}$ level gate signal line.

In an embodiment, in the special-shaped screen, the number of the pixel circuit located at one end of each row of the plurality of pixel circuits is one.

Figure 2:
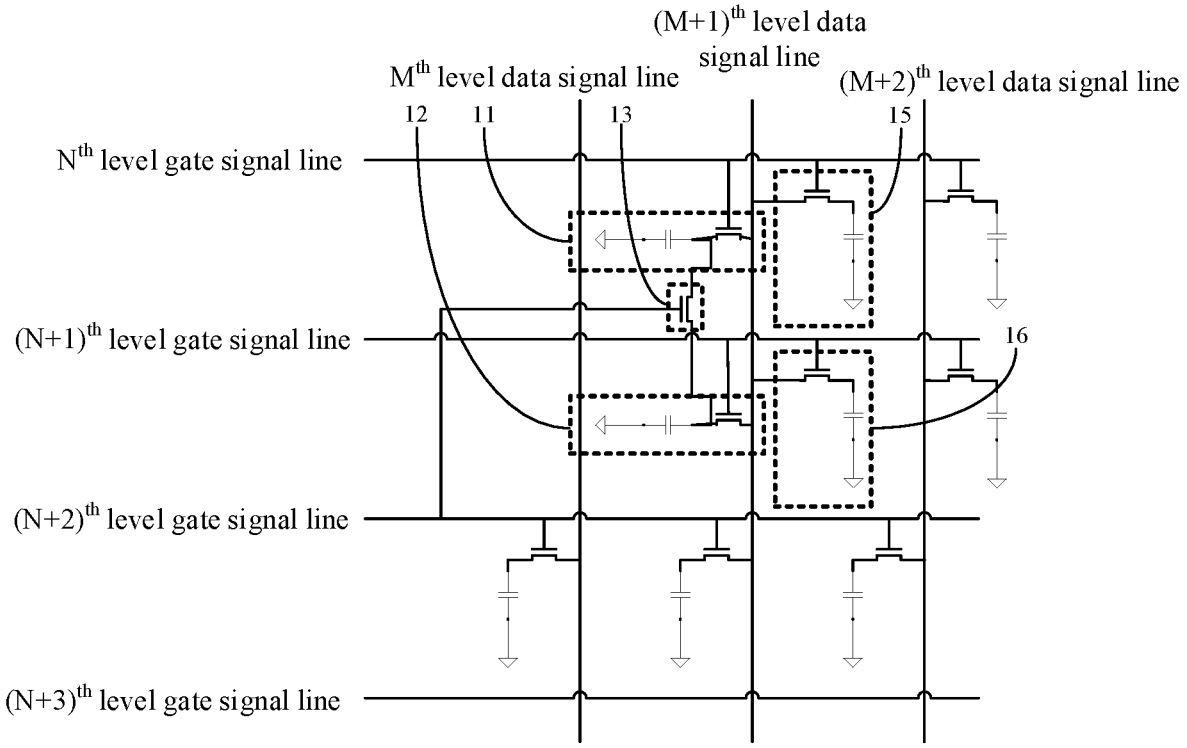
FIG. 2 is a structural schematic view of the display circuit of the special-shaped screen according to another embodiment of the present disclosure.

FIG. 2 is a structural schematic view of the display circuit of the special-shaped screen according to another embodiment of the present disclosure. As shown in FIG. 2, among all of the pixel circuits 10, an edge pixel circuit located at a left end of the $N^{th}$ row is the first edge pixel circuit 11, an edge pixel circuit located at a left end of the $(N+1)^{th}$ row is the second edge pixel circuit 12, and the first edge pixel circuit 11 is adjacent to the second edge pixel circuit 12.

In the above way, each group of the first edge pixel circuit 11 and the second edge pixel circuit 12 in all of the pixel circuits 10 may display with the corresponding third luminance described above, which weakens the jagged effect at the edge of the special-shaped screen and improves the display effect of the special-shaped screen.

In some embodiments, the pixel circuit 10 other than the edge pixel circuits in the plurality of pixel circuits 10 is taken as the non-edge pixel circuit. A non-edge pixel circuit located on the same row with and adjacent to the first edge pixel circuit 11 is taken as a first adjacent-edge pixel circuit 15, and a non-edge pixel circuit located on the same row with and adjacent to the second edge pixel circuit 12 is taken as a second adjacent-edge pixel circuit 16.

The first edge pixel circuit, the second edge pixel circuit, the first adjacent-edge pixel circuit, and the second adjacent-edge pixel circuit are connected to the same-level data signal line.

For example, as shown in FIG. 2, the pixel circuit located at the same row with and adjacent to the edge pixel circuit at the left end of the $N^{th}$ row of the plurality of the pixel circuits is a first adjacent-edge power supply circuit 15, and the pixel circuit located at the same row with and adjacent to the edge pixel circuit at the left end of the $(N+1)^{th}$ row of the plurality of the pixel circuits is a second adjacent-edge power supply circuit 16. Both the first adjacent-edge power supply circuit 15 and the second adjacent-edge power supply circuit 16 are located at non-edge positions of the special-shaped screen.

In an embodiment, the first end of the first switch transistor 101 of the first edge pixel circuit 11, the first end of the first switch transistor 101 of the second edge pixel circuit 12, the first end of the first switch transistor 101 of the first adjacent-edge power supply circuit 15, and the first end of the first switch transistor 101 of the second adjacent-edge power supply circuit 16 are all connected to the same data line to receive the corresponding data signal (such as the signal transmitted by the $(M+1)^{th}$ level data signal line as shown in FIG. 2).

In the above way, the first adjacent-edge power supply circuit 15 is allowed to display with the first luminance, the second adjacent-edge power supply circuit 16 is allowed to display with the second luminance, and the first edge pixel circuit 11/the second edge pixel circuit 12 is allowed to display with the third luminance. The third luminance is between the first luminance and the second luminance. In this way, the jagged effect of the special-shaped screen is further weakened and the display effect of the special-shaped screen is improved.

Figure 3:
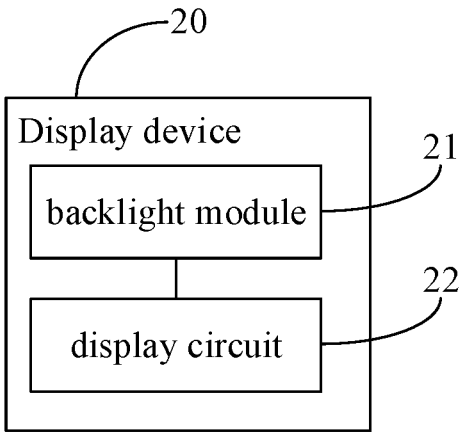
FIG. 3 is a structural schematic view of a display device according to an embodiment of the present disclosure.

A display device is also disclosed in the present disclosure. FIG. 3 is a structural schematic view of the display device according to an embodiment of the present disclosure. As shown in FIG. 3, the display device 20 includes a backlight module 21 and a display circuit 22, and the display circuit 22 may be any one of the display circuits described in the above embodiments, which will not be repeated herein.

Different from the related art, in the technical solution of the present disclosure, the pixel circuits located at both ends of each row of the plurality of pixel circuits are taken as the edge pixel circuits, one of two adjacent edge pixel circuits is connected to the $N^{th}$ level gate signal line to receive the gate signal in the $N^{th}$ level, the other one of the two adjacent edge pixel circuits is connected to the $(N+1)^{th}$ level gate signal line to receive the gate signal in the $(N+1)^{th}$ level. By the control end of the voltage-dividing circuit being connected to the $(N+M)^{th}$ level gate signal line, the voltages on the storage capacitors of the two adjacent edge pixel circuits are neutralized in response to receiving the gate signal in the $(N+M)^{th}$ level and the two adjacent edge pixel circuits may have the equal storage voltages. In this way, the two adjacent edge pixel circuits may both display with the luminance corresponding to the storage voltages after the voltages are neutralized, such that the jagged effect occurred when the pixel circuits at the edge of the special-shaped screen display may be weakened and the display effect of the special-shaped screen may be improved.

In the description of the present specification, the description with reference to the terms "one embodiment", "some embodiments", "illustrative embodiment", "example", "specific example", or "some examples", and the like, means that a specific feature, structure, material, or characteristic described in connection with the embodiment or example is included in at least one embodiment or example of the present disclosure. Thus, the illustrative descriptions of the terms throughout this specification are not necessarily referring to the same embodiment or example of the present disclosure. Furthermore, the specific features, structures, materials, or characteristics may be combined in any suitable manner in one or more embodiments or examples. In addition, various embodiments or examples described in the specification and features of various embodiments or examples, may be incorporated and combined by those skilled in the art in case of an absence of confliction.

In addition, terms such as "first", "second", and the like, are used herein for purposes of description, and are not intended to indicate or imply relative importance or significance or to imply the number of indicated technical features. Thus, the feature defined with "first", "second", and the like may include one or more of such a feature. In addition, terms such as "first", "second", and the like, are used herein for purposes of description, and are not intended to indicate or imply relative importance or significance or to imply the number of indicated technical features. Thus, the feature defined with "first", "second", and the like may include one or more of such a feature.

Any process or method description in the flowcharts or described in other means herein may be understood to represent a module, a segment or a portion of codes including one or more executable instructions for implementing the blocks of a custom logic function or process. Besides, the scope of the embodiments of the present disclosure may include additional implementations, in which the functions may not be performed in the shown or discussed order, and may be performed in a substantially simultaneous manner or in an opposite order, according to the functions involved. This will be understood by those skilled in the art of the present disclosure.

The logic and/or steps described in other manners herein or shown in the flow chart, for example, a particular order list of executable instructions for realizing the logical function, may be specifically achieved in any computer-readable medium to be used by an instruction execution system, a device or an equipment (may be a personal computer, a server, a network device or other systems capable of acquiring an instruction from the instruction execution system, device and equipment and executing the instruction), or to be used in combination with the instruction execution system, device and equipment. As to the specification, "the computer-readable medium" may be any device adaptive for including, storing, communicating, propagating or transferring programs to be used by or in combination with the instruction execution system, device or equipment. More specific examples of the computer-readable medium may include but be not limited to: an electronic connection (an electronic device) with one or more wires, a portable computer enclosure (a magnetic device), a random-access memory (RAM), a read-only memory (ROM), an erasable programmable read-only memory (EPROM or a flash memory), an optical fiber device and a portable compact disk read-only memory (CDROM). In addition, the computer-readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

The above description is only implementations of the present disclosure, and is not intended to limit the scope of the present disclosure. Any equivalent structure or equivalent process transformation based on the contents of the specification and the accompanying drawings, or any direct or indirect application in other related technical fields, is included in the scope of the present disclosure.

What is claimed is:

1. A display circuit of a special-shaped screen, comprising:

a plurality of pixel circuits, arranged in a special-shaped region of the special-shaped screen in a manner of a non-rectangular array; wherein pixel circuits located at both ends of each row of the plurality of pixel circuits are edge pixel circuits, one of two adjacent edge pixel circuits is connected to a $N^{th}$ level gate signal line, the other one of the two adjacent edge pixel circuits is connected to a $(N+1)^{th}$ level gate signal line, and N is a natural number greater than 0; and a voltage-dividing circuit, connected to each of the two adjacent edge pixel circuits, respectively, to enable the two adjacent edge pixel circuits to have equal storage voltages, a control end of the voltage-dividing circuit being connected to a $(N+M)^{th}$ level gate signal line, and M being a natural number greater than 2;

wherein a signal transmitted by the $N^{th}$ level gate signal line, a signal transmitted by the $(N+1)^{th}$ level gate signal line, and a signal transmitted by the $(N+M)^{th}$ level gate signal line are output in sequence according to an order from front to back.

2. The display circuit according to claim 1, comprising:

a plurality of pixel circuits, arranged in a rectangular region of the special-shaped screen in a manner of a rectangular array; and the plurality of pixel circuits, arranged in the special-shaped screen in the manner of the non-rectangular array.

3. The display circuit according to claim 2, wherein an entire display region of the special-shaped screen comprises the special-shaped region and the rectangular region.

4. The display circuit according to claim 1, wherein an edge pixel circuit located at one end of a $N^{th}$ row of the plurality of pixel circuits comprises:

a first edge pixel circuit, connected to the $N^{th}$ level gate signal line; and a second edge pixel circuit, adjacent to the first edge pixel circuit, and connected to the $(N+1)^{th}$ level gate signal line.

5. The display circuit according to claim 4, wherein a pixel circuit other than the edge pixel circuits in the plurality of pixel circuits is a non-edge pixel circuit, and a non-edge pixel circuit located on the same row with and adjacent to the first edge pixel circuit or the second edge pixel circuit is an adjacent-edge pixel circuit;

wherein the first edge pixel circuit, the second edge pixel circuit, and the adjacent-edge pixel circuit are connected to a same-level data signal line.

6. The display circuit according to claim 1, wherein an edge pixel circuit located at one end of a $N^{th}$ row of the plurality of pixel circuits is a first edge pixel circuit, and an edge pixel circuit located at one end of a $(N+1)^{th}$ row of the plurality of pixel circuits and adjacent to the first edge pixel circuit is a second edge pixel circuit;

wherein the first edge pixel circuit is connected to the $N^{th}$ level gate signal line, and the second edge pixel circuit is connected to the $(N+1)^{th}$ level gate signal line.

7. The display circuit according to claim 6, wherein a pixel circuit other than the edge pixel circuits in the plurality of pixel circuits is a non-edge pixel circuit, a non-edge pixel circuit located on the same row with and adjacent to the first edge pixel circuit is a first adjacent-edge pixel circuit, and a non-edge pixel circuit located on the same row with and adjacent to the second edge pixel circuit is a second adjacent-edge pixel circuit;

wherein the first edge pixel circuit, the second edge pixel circuit, the first adjacent-edge pixel circuit, and the second adjacent-edge pixel circuit are connected to a same-level data signal line.

8. The display circuit according to claim 1, wherein M is equal to 2.

9. The display circuit according to claim 1, wherein each pixel circuit comprises:

a first switch transistor; and a storage capacitor;

wherein a driving end of the first switch transistor is connected to a corresponding gate signal line, a first end of the first switch transistor is connected to a corresponding data signal line, a second end of the first switch transistor is connected to a first end of the storage capacitor, and a second end of the storage capacitor is connected to a corresponding common electrode.

10. The display circuit according to claim 9, wherein the voltage-dividing circuit comprises:

a second switch transistor;

wherein a first end of the second switch transistor is connected to the first end of the storage capacitor of one of the two adjacent edge pixel circuits, a second end of the second switch transistor is connected to the first end of the storage capacitor of the other one of the two adjacent edge pixel circuits, and a driving end of the second switch transistor is connected to the $(N+M)^{th}$ level gate signal line.

11. A display device, comprising:

a backlight module; and a display circuit, comprising:

a plurality of pixel circuits, arranged in a special-shaped region of the special-shaped screen in a manner of a non-rectangular array; wherein pixel circuits located at both ends of each row of the plurality of pixel circuits are edge pixel circuits, one of two adjacent edge pixel circuits is connected to a $N^{th}$ level gate signal line, the other one of the two adjacent edge pixel circuits is connected to a $(N+1)^{th}$ level gate signal line, and N is a natural number greater than 0;

a voltage-dividing circuit, connected to each of the two adjacent edge pixel circuits, respectively, to enable the two adjacent edge pixel circuits to have equal storage voltages, a control end of the voltage-dividing circuit being connected to a $(N+M)^{th}$ level gate signal line, and M being a natural number greater than 2;

wherein a signal transmitted by the $N^{th}$ level gate signal line, a signal transmitted by the $(N+1)^{th}$ level gate signal line, and a signal transmitted by the $(N+M)^{th}$ level gate signal line are output in sequence according to an order from front to back.

12. The display device according to claim 11, wherein the display circuit comprises:

a plurality of pixel circuits, arranged in a rectangular region of the special-shaped screen in a manner of a rectangular array; and the plurality of pixel circuits, arranged in the special-shaped screen in the manner of the non-rectangular array.

13. The display device according to claim 12, wherein an entire display region of the special-shaped screen comprises the special-shaped region and the rectangular region.

14. The display device according to claim 11, wherein an edge pixel circuit located at one end of a $N^{th}$ row of the plurality of pixel circuits comprises:

a first edge pixel circuit, connected to the $N^{th}$ level gate signal line; and a second edge pixel circuit, adjacent to the first edge pixel circuit, and connected to the $(N+1)^{th}$ level gate signal line.

15. The display device according to claim 14, wherein a pixel circuit other than the edge pixel circuits in the plurality of pixel circuits is a non-edge pixel circuit, and a non-edge pixel circuit located on the same row with and adjacent to the first edge pixel circuit or the second edge pixel circuit is an adjacent-edge pixel circuit;

wherein the first edge pixel circuit, the second edge pixel circuit, and the adjacent-edge pixel circuit are connected to a same-level data signal line.

16. The display device according to claim 11, wherein an edge pixel circuit located at one end of a $N^{th}$ row of the plurality of pixel circuits is a first edge pixel circuit, and an edge pixel circuit located at one end of a $(N+1)^{th}$ row of the plurality of pixel circuits and adjacent to the first edge pixel circuit is a second edge pixel circuit;

wherein the first edge pixel circuit is connected to the $N^{th}$ level gate signal line, and the second edge pixel circuit is connected to the $(N+1)^{th}$ level gate signal line.

17. The display device according to claim 16, wherein a pixel circuit other than the edge pixel circuits in the plurality of pixel circuits is a non-edge pixel circuit, a non-edge pixel circuit located on the same row with and adjacent to the first edge pixel circuit is a first adjacent-edge pixel circuit, and a non-edge pixel circuit located on the same row with and adjacent to the second edge pixel circuit is a second adjacent-edge pixel circuit;

wherein the first edge pixel circuit, the second edge pixel circuit, the first adjacent-edge pixel circuit, and the second adjacent-edge pixel circuit are connected to a same-level data signal line.

18. The display device according to claim 11, wherein M is equal to 2.

19. The display device according to claim 11, wherein each pixel circuit comprises:

a first switch transistor; and a storage capacitor;

wherein a driving end of the first switch transistor is connected to a corresponding gate signal line, a first end of the first switch transistor is connected to a corresponding data signal line, a second end of the first switch transistor is connected to a first end of the storage capacitor, and a second end of the storage capacitor is connected to a corresponding common electrode.

20. The display device according to claim 19, wherein the voltage-dividing circuit comprises:

a second switch transistor;

wherein a first end of the second switch transistor is connected to the first end of the storage capacitor of one of the two adjacent edge pixel circuits, a second end of the second switch transistor is connected to the first end of the storage capacitor of the other one of the two adjacent edge pixel circuits, and a driving end of the second switch transistor is connected to the $(N+M)^{th}$ level gate signal line.

* * * * *